US009319769B2

(12) United States Patent
Burgett et al.

(10) Patent No.: US 9,319,769 B2
(45) Date of Patent: Apr. 19, 2016

(54) WIRELESS HEADPHONES

(71) Applicant: Harman International Industries, Incorporated, Stamford, CT (US)

(72) Inventors: Seth D. Burgett, Glen Carbon, IL (US); Effrosini A. Karayiannis, St. Louis, MO (US); Aaron Gorga, St. Louis, MO (US)

(73) Assignee: Harman International Industries, Incorporated, Stamford, CT (US)

( * ) Notice: Subject to any disclaimer, the term of this patent is extended or adjusted under 35 U.S.C. 154(b) by 31 days.

(21) Appl. No.: 14/253,681

(22) Filed: Apr. 15, 2014

(65) Prior Publication Data

US 2014/0307891 A1 Oct. 16, 2014

Related U.S. Application Data

(60) Provisional application No. 61/812,229, filed on Apr. 15, 2013.

(51) Int. Cl.
*H04R 1/10* (2006.01)
*H04R 5/033* (2006.01)

(52) U.S. Cl.
CPC ..... *H04R 1/105* (2013.01); *H04R 1/1016* (2013.01); *H04R 5/0335* (2013.01); *H04R 2420/07* (2013.01)

(58) Field of Classification Search
CPC ..... H04R 5/033; H04R 5/04; H04R 1/1041; H04R 1/1016; H04R 2420/07
USPC ..... 381/74
See application file for complete search history.

(56) References Cited

U.S. PATENT DOCUMENTS

| | | | | | |
|---|---|---|---|---|---|
| 4,845,751 | A * | 7/1989 | Schwab | H04H 20/88 | 381/105 |
| 5,095,382 | A * | 3/1992 | Abe | H04B 10/114 | 320/107 |
| 5,349,386 | A * | 9/1994 | Borchardt | H04B 1/0096 | 348/485 |
| 2004/0037444 | A1* | 2/2004 | Redmer | H04R 1/1058 | 381/370 |
| 2004/0134710 | A1* | 7/2004 | Yang | H04R 1/1066 | 181/129 |
| 2005/0185814 | A1* | 8/2005 | Chen | H04R 1/1066 | 381/381 |
| 2007/0258613 | A1* | 11/2007 | Wright | H04R 1/105 | 381/374 |
| 2008/0080704 | A1* | 4/2008 | te Riet | H04R 1/1066 | 379/430 |
| 2008/0187164 | A1* | 8/2008 | Chou | H04R 1/1033 | 381/381 |
| 2008/0310666 | A1* | 12/2008 | Wengreen | H04R 1/026 | 381/381 |

(Continued)

*Primary Examiner* — Simon Sing
(74) *Attorney, Agent, or Firm* — Brooks Kushman P.C.

(57) ABSTRACT

Wireless headphones include left and right earphones connected by a cable. Each of the left and right earphones comprising a generally C-shaped body adapted to fit behind the user's ear, with a concave inner edge, a convex outer edge, a first end that is positioned generally adjacent the top of the user's ear and a second end positioned generally adjacent the bottom of the user's ear when the body is positioned behind the user's ear. A speaker having a sound tunnel associated therewith adapted to fit in the ear canal of the wearer; a resilient support extending forwardly and downwardly from the top end of the C-shaped body, the support normally supporting the speaker in a position which, when the C-shaped body behind the user's ear, is misaligned with the user's ear canal, but resiliently deflects to allow the sound tunnel to align with and be inserted into the user's ear canal, thereby resiliently biasing the C-shaped body against the user's head.

20 Claims, 9 Drawing Sheets

(56) References Cited

U.S. PATENT DOCUMENTS

2009/0022352 A1* 1/2009 Weibel ..... H04R 1/1066 381/378
2009/0135017 A1* 5/2009 Lee ..... H04R 1/1025 340/636.1
2011/0170703 A1* 7/2011 Palma ..... H04R 1/1041 381/74
2012/0070028 A1* 3/2012 Margulies ..... H04R 1/105 381/380

* cited by examiner

WIRELESS HEADPHONES

CROSS-REFERENCE TO RELATED APPLICATIONS

This application claims priority to U.S. Provisional Patent Application Ser. No. 61/812,229, filed Apr. 15, 2013. The entire disclosure of the above-referenced application is incorporated herein.

FIELD

The present disclosure relates to wireless headphones, and in particular to wireless headphones that securely but comfortably engage the user's ears.

BACKGROUND

This section provides background information related to the present disclosure which is not necessarily prior art.

Wireless headphones provide a convenient way for a user to listen to music without a wired connection to a music player or telephone. However because wireless headphones must include an independent power supply and wireless communication device, these headphones are usually heavier than conventional earbuds. This extra weight can make wireless headphone more susceptible to becoming displaced, particularly when used during vigorous activities.

SUMMARY

This section provides a general summary of the disclosure, and is not a comprehensive disclosure of its full scope or all of its features.

Embodiments of this invention provide wireless headphones that securely, but comfortably engage the user's ears, so that the headphones remain in place, even during vigorous activity.

A preferred embodiment of a wireless headphone comprises left and right earphones connected by a cable. Each of the left and right earphones comprising a generally C-shaped body adapted to fit behind the user's ear. This body has a concave inner edge, a convex outer edge, and a first end that is positioned generally adjacent the top of the user's ear and a second end positioned generally adjacent the bottom of the user's ear when the body is positioned behind the user's ear. Each earphone also comprises a speaker having a sound tunnel associated therewith that is adapted to fit in the ear canal of the wearer. A resilient support, extending forwardly and downwardly from the top end of the C-shaped body, which in its normal configuration supports the speaker in a position in which the sound tunnel is misaligned with the user's ear canal, but the support can resiliently deflect to allow the sound tunnel to align with and be inserted into the user's ear canal, thereby resilient engaging the earphone with the user's head.

In some embodiments, the distance between the concave inner edge of the earphone and the sound tunnel is less than the distance between back of the user's ear and the ear canal. In these embodiments the support resilient deflects by bending to allow the sound tunnel to align with and be inserted into the user's ear canal, thereby resilient biasing the concave inner edge of the C-shaped body against the back of the user's ear.

In some embodiments, the angle of the sound tunnel is misaligned with the angle of the user's ear canal. In these embodiments the support resiliently deflects by twisting to allow the sound tunnel to align with and be inserted into the user's ear canal, thereby resiliently biasing the C-shaped body against the side of the user's head.

In the preferred embodiment, the distance between the concave inner edge of the earphone and the sound tunnel is less than the distance between back of the user's ear and the ear canal and the angular orientation of the sound tunnel is misaligned with the angle of the user's ear canal. In these embodiments the support resilient deflects by bending to allow the sound tunnel to align with and be inserted into the user's ear canal, thereby resiliently biasing the concave inner edge of the C-shaped body against the back of the user's ear, and the support resiliently deflects by twisting to allow the sound tunnel to align with and be inserted into the user's ear canal, thereby resiliently biasing the C-shaped body against the side of the user's head.

In the preferred embodiment the support is generally L-shaped, with a first portion extending generally outwardly from the first end of the C-shaped body, and a second portion extending from the end of the first portion, generally parallel to the C-shaped body.

The C-shaped body preferably comprises a hard resilient exoskeleton forming the convex outer edge, with a compliant material with a textured surface on the concave inner edge. The C-shaped body preferably has a generally triangular or wedge-shaped transverse cross-section, being wider at the convex outer edge and narrower at the concave inner edge. The textured surface preferably comprises a network of raised, hollow polygons, such as hexagons. The C-shaped body is preferably curved in the plane of the C-shaped body, to accommodate the curve of the user's head.

The headphones can comprise a light source, for example on the support of at least one of the earphones, oriented to face the user's ear when the earphone is mounted on the user's ear. This light source can emit non-white colored light, and preferably includes an LED.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
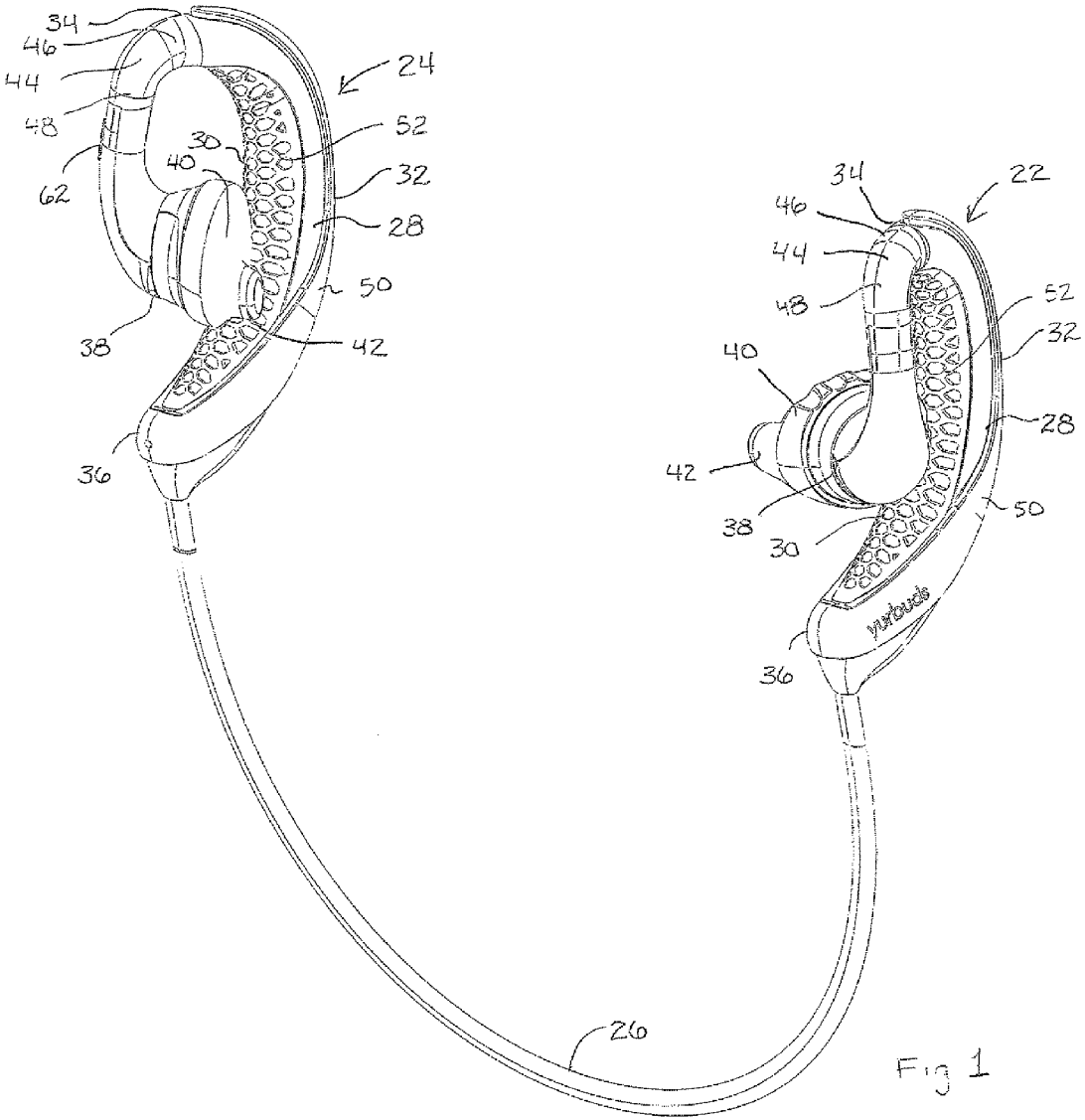
FIG. 1 is a perspective view of a preferred embodiment of headphones, in accordance with the principles of this invention.
Figure 3:
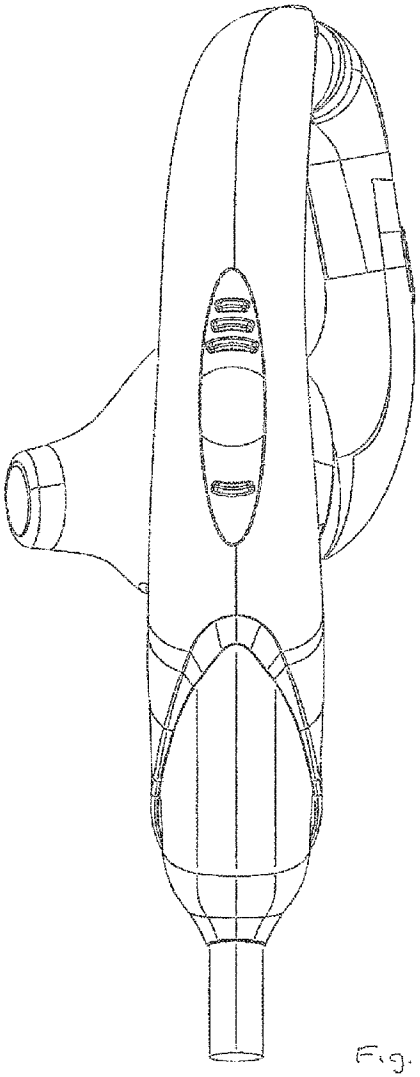
FIG. 3 is a front elevation view of the right ear earphone.
Figure 2:
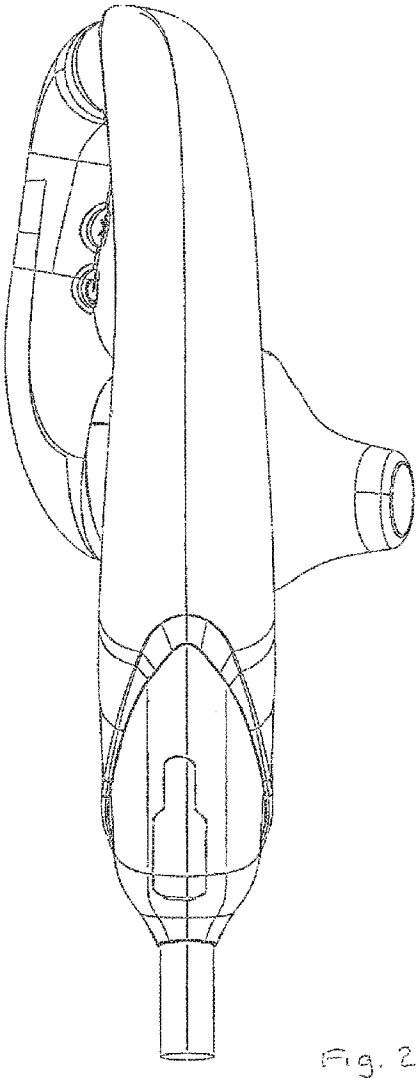
FIG. 2 is a front elevation view of the left ear earphone.

A preferred embodiment of a wireless headphone in accordance with the principles of this invention is indicated generally as 20 in FIG. 1. Headphones 20 comprise left and right earphones 22 and 24 connected by a cable 26. Each of the left and right earphones comprises a generally C-shaped body 28 adapted to fit behind the user's ear. This body 28 has a concave inner edge 30, a convex outer edge 32, and a first end 34 that is positioned generally adjacent the top of the user's ear and a second end positioned generally adjacent the bottom of the user's ear when the body 28 is positioned behind the user's ear.

Each earphone 22, 24 also comprises a speaker 38 having an enhancer 40 with a sound tunnel 42 associated therewith that is adapted to fit in the ear canal of the user. A resilient support 44, extends forwardly and downwardly from the first end 34 of the C-shaped body 28. The resilient support 44, in its normal configuration, supports the speaker 38 in a position in which the sound tunnel 42 is not aligned with the user's ear canal, but the resilient support 44 can resiliently deflect to allow the sound tunnel 32 to align with and be inserted into the user's ear canal, thereby resilient engaging the earphone with the user's head.

In some embodiments, the distance between the concave inner edge 30 of the earphone 22, 24 and the sound tunnel 42 is less than the distance between back of the user's ear and the user's ear canal. In these embodiments the resilient support 44 resiliently deflects by bending to allow the sound tunnel 42 to align with and be inserted into the user's ear canal, thereby resilient biasing the concave inner edge 30 of the C-shaped body 28 against the back of the user's ear.

In some embodiments, the angular orientation of the sound tunnel 42 is misaligned with the angle of the user's ear canal. In these embodiments the resilient support 44 resiliently deflects by twisting to allow the sound tunnel 44 to align with and be inserted into the user's ear canal, thereby resiliently biasing the C-shaped body 28 against the side of the user's head.

In this preferred embodiment, the distance between the concave inner edge 30 of the earphone 28 and the sound tunnel 42 is less than the distance between back of the user's ear and the ear canal, and the angular orientation of the sound tunnel 42 is misaligned with the angle of the user's ear canal. In this preferred embodiment the resilient support 44 resiliently deflects by bending to allow the sound tunnel 42 to align with and be inserted into the user's ear canal, thereby resiliently biasing the concave inner edge 30 of the C-shaped body 28 against the back of the user's ear, and the resilient support 44 resiliently deflects by twisting to allow the sound tunnel 42 to align with and be inserted into the user's ear canal, thereby resiliently biasing the C-shaped body 28 against the side of the user's head.

In the preferred embodiment the resilient support 44 is generally L-shaped, with a first portion 46 extending generally outwardly from the first end 34 of the C-shaped body 28, and a second portion 48 extending from the end of the first portion, generally parallel to the C-shaped body.

Figure 5:
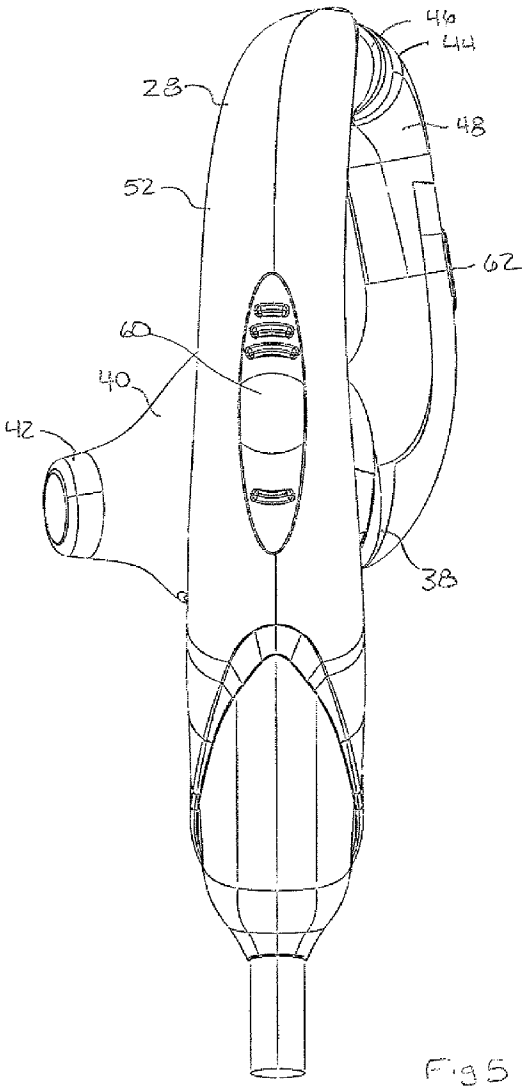
FIG. 5 is a rear elevation view of the right ear earphone.
Figure 4:
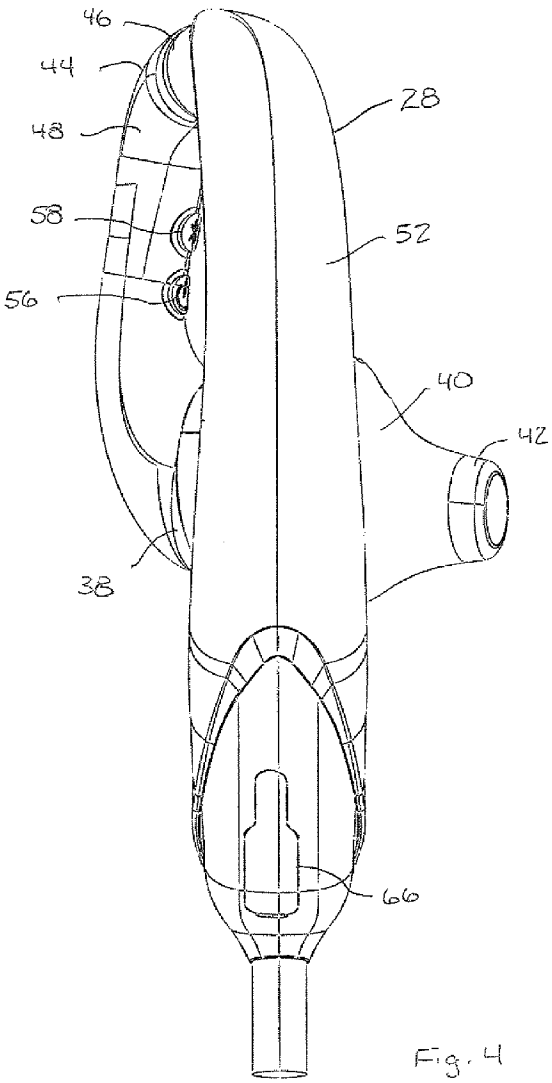
FIG. 4 is a rear elevation view of the left ear earphone.
Figure 7:
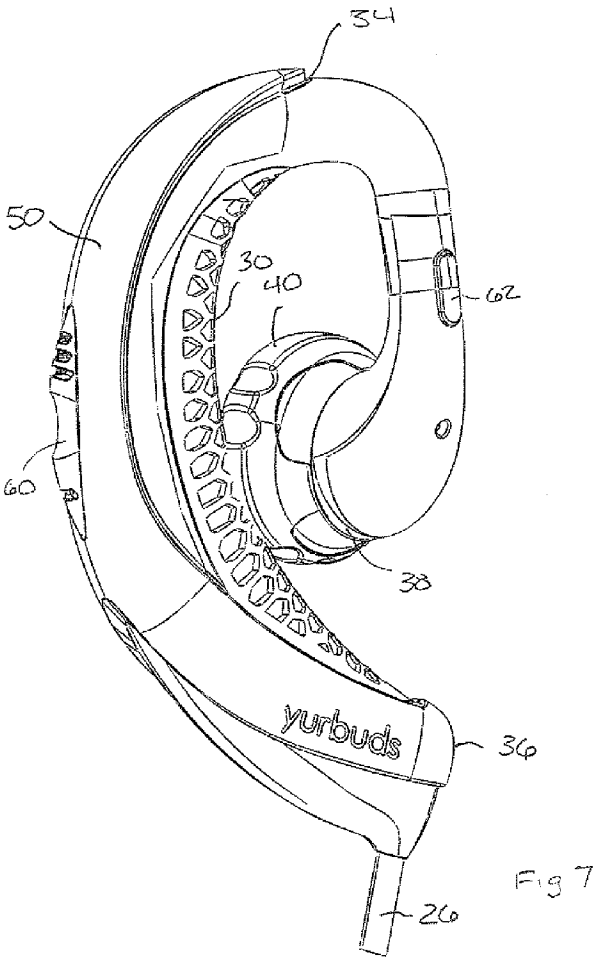
FIG. 7 is a perspective view (from the left rear side) of the right ear earphone.
Figure 6:
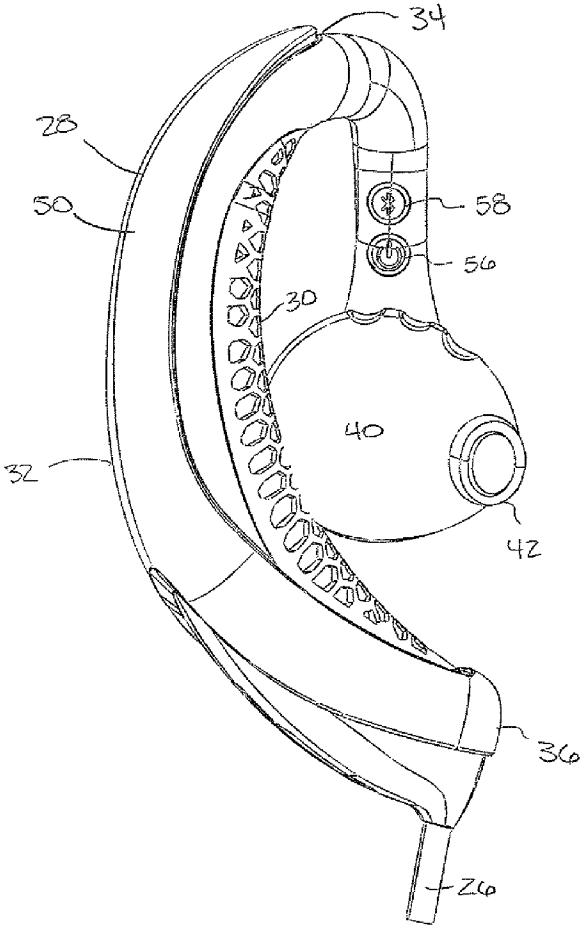
FIG. 6 is a perspective view (from the left rear side) of the left ear earphone.
Figure 9:
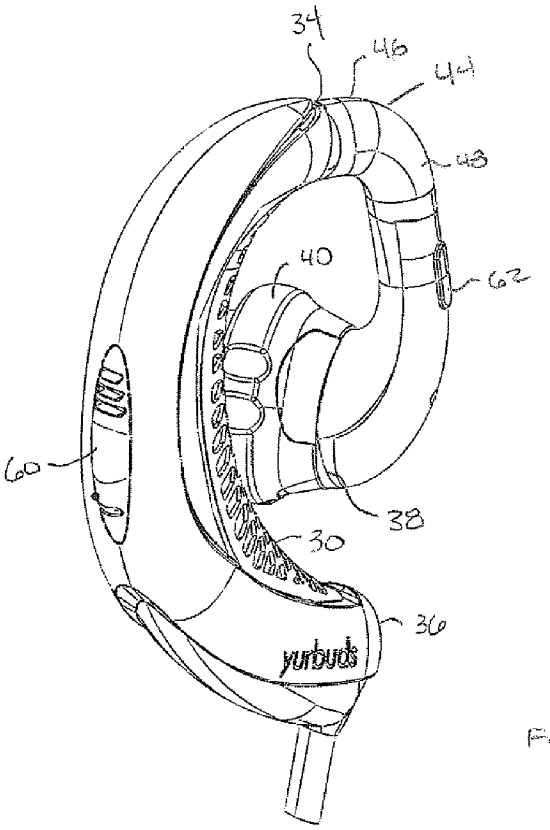
FIG. 9 is a perspective view (from the left rear side) of the right ear earphone.
Figure 8:
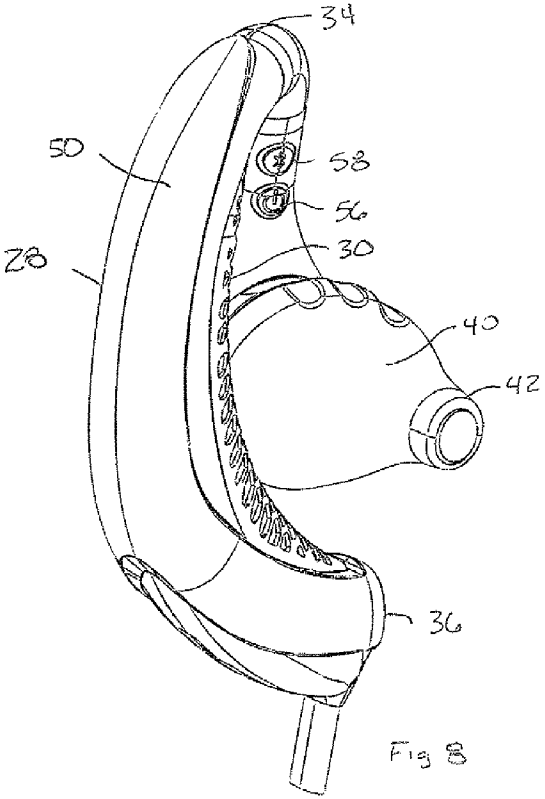
FIG. 8 is a perspective view (from the left rear side) of the left ear earphone.
Figure 10:
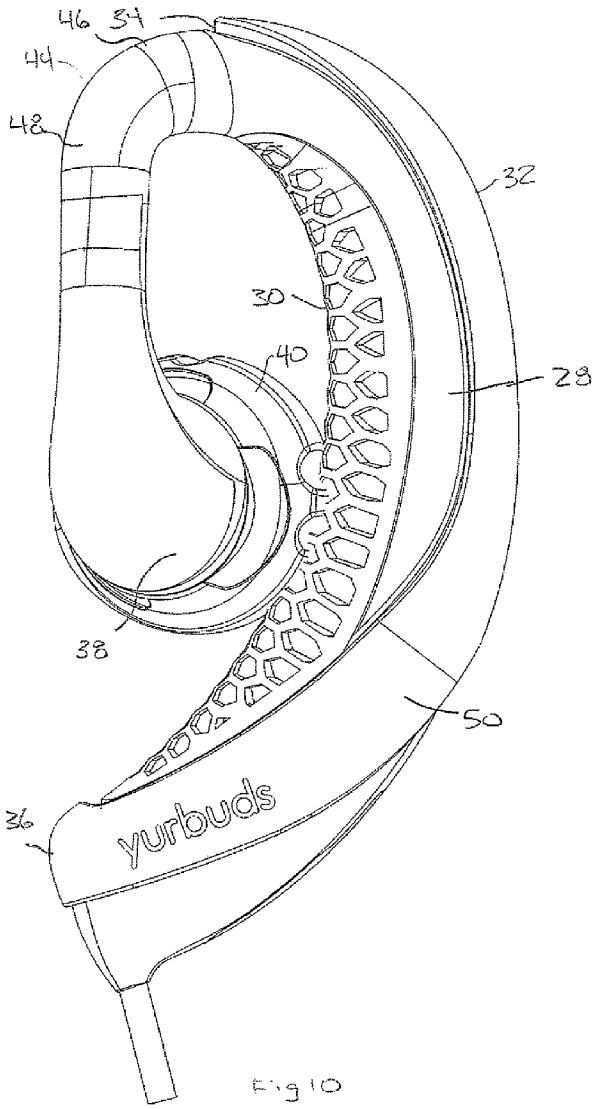
FIG. 10 is a perspective view (from the right front side) of the left ear earphone.
Figure 11:
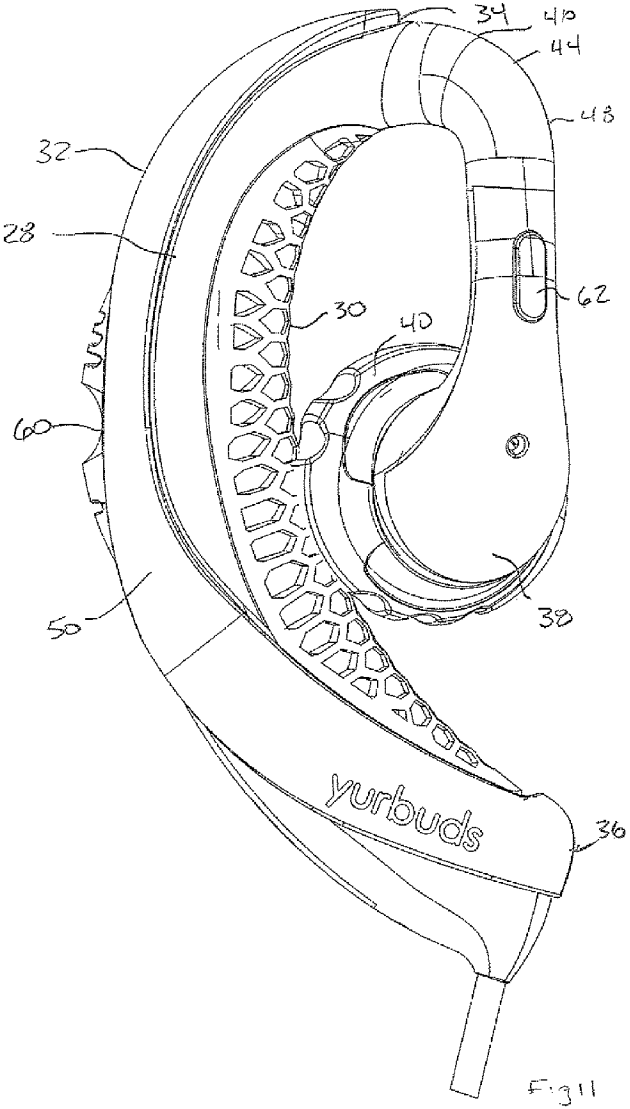
FIG. 11 is a perspective view (from the right front side) of the right ear earphone.
Figure 13:
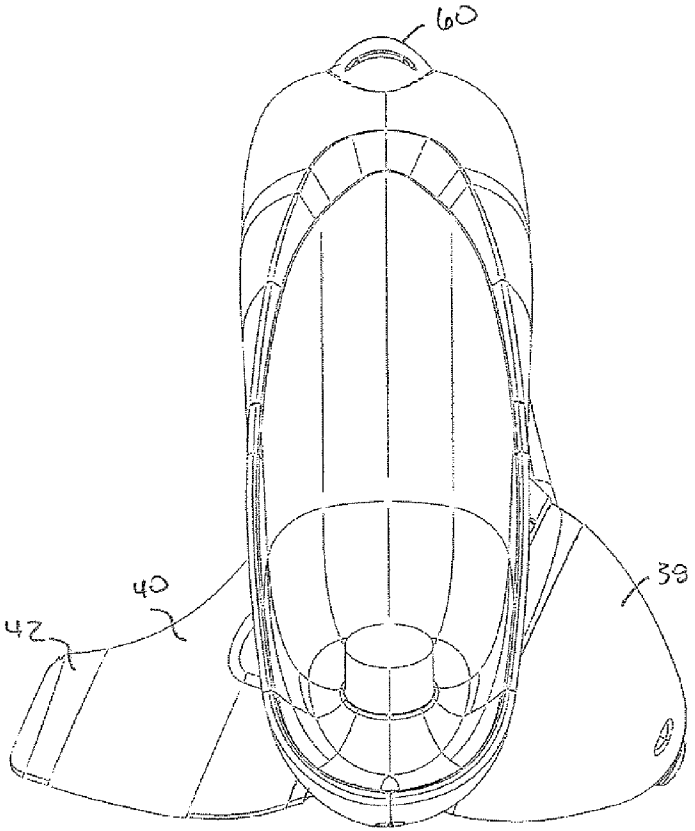
FIG. 13 is a bottom plan view of the right ear earphone.
Figure 12:
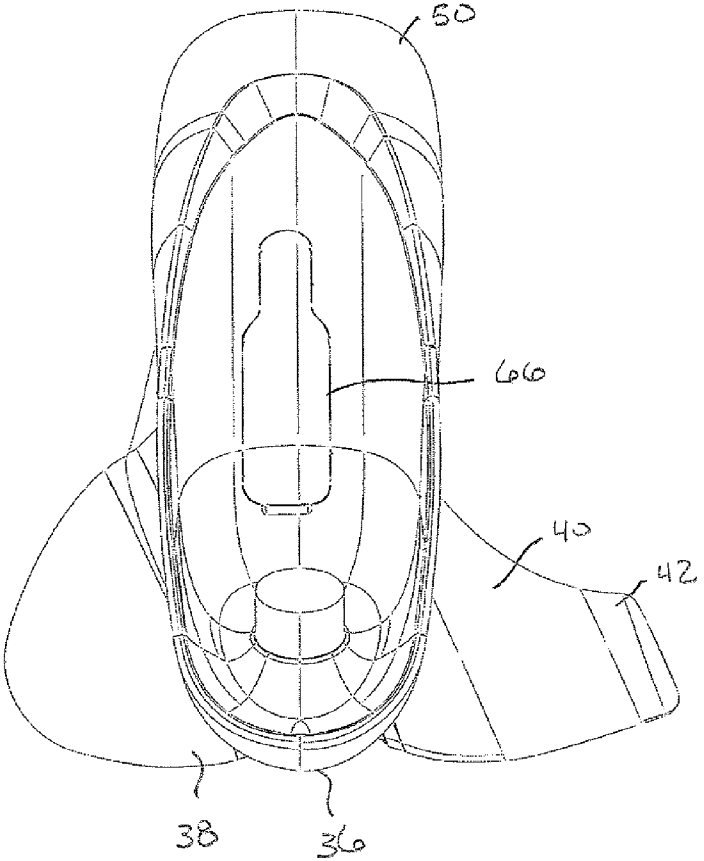
FIG. 12 is a bottom plan view of the left ear earphone.
Figure 15:
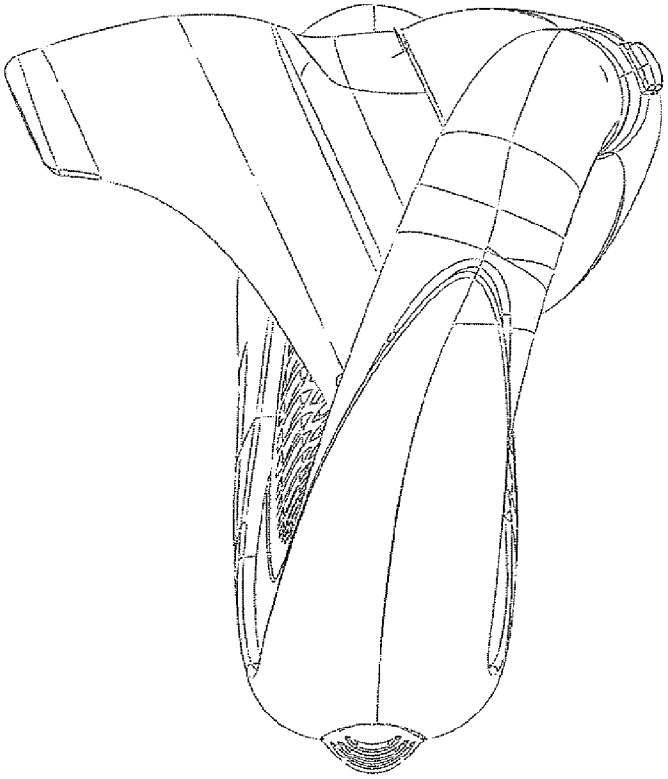
FIG. 15 is a top plan view of the left ear earphone.
Figure 14:
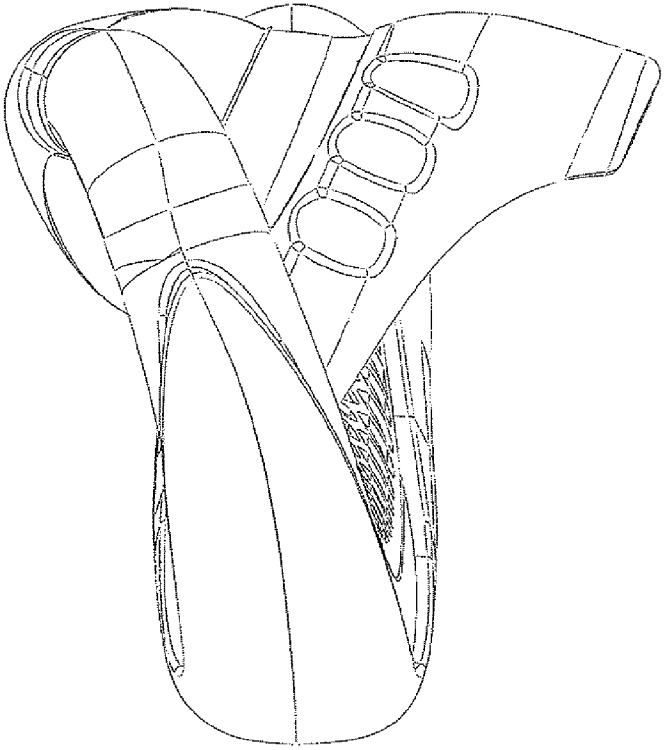
FIG. 14 is a top plan view of the left ear earphone.

The C-shaped body 28 preferably comprises a hard resilient exoskeleton 50 forming the convex outer edge 32, with a compliant material with a textured surface 52 on the concave inner edge 30. The C-shaped body 28 preferably has a generally triangular or wedge-shaped transverse cross-section, being wider at the convex outer edge 32 and narrower at the concave inner edge 30. The textured surface 24 preferably comprises a network of raised, hollow polygons, such as hexagons. As best shown in FIGS. 4 and 5, the C-shaped body 28 is preferably twists along its longitudinal axis to form a curve in the plane of the C-shaped body to accommodate the curve of the user's head. As shown in FIGS. 4 and 5, the C-shaped body 28 of the left earphone 22 twists outwardly from the second end 36 to the first end 34.

The headphones 20 can comprise a light source, for example on the support of at least one of the earphones, oriented to face the user's ear when the earphone is mounted on the user's ear. This light source can emit non-white colored light, and preferably includes an LED. As shown in the Figures there are two lighted buttons 56 and 58. The button 56 is a power button, which can be used to turn on the headphones. The button 56 can include a light source, such as an LED, that illuminates when the button 56 is pressed, and/or when the power is on. The light source can be any color, but in this preferred embodiment is green. The button 58 is a blue tooth button, which can be used to connect the headphones 20 to a signal source, such as an mp3 player or phone. The button 58 can include a light source, such as an LED, that illuminates when the button 58 is pressed, and/or when a blue tooth connection is active. This light source is preferably blue.

Because of the unique positioning of the buttons 56 and 58 in opposition to the user's ear, the lights associated with the buttons can light up the user's ear, producing a unique effect. Additional lighted controls, indicator lights, or decorative lights can be provided on the earphones 22, 24. For example, additional light sources can be provided on the resilient support to shine on the user's ear to provide decorative lighting effect. These light sources can be LEDs that provide bright light with low power consumption. In particular, an R-G-B diodes can be used that can produce a variety of different colored light. While these lights can be purely decorative, and preferably in a color or colors selected by the user. Alternatively these lights can be indicators, for example turning on, blinking, or changing color based on a number of factors, for example, the type, volume, or rhythm of the music being played; physiologic measurements of the user, for example heart rate, which can be measured by sensors on the headphones, or on another device communicating with the headphones, or distance traveled of speed of travel, which can be measured sensors on the headphones, or another device, such as a gps enabled wristwatch or phone, communicating with the headphones.

The headphones 20 preferably include a switch 60 for controlling sound signal played by the headphones. The switch 60 preferably provides three controls, for example increase volume by pressing the upper portion of the switch, decrease volume by pressing the lower portion of the switch, and change song or change source by pressing the center portion of the switch.

Other controls can be provided on the headphones 20, for example a switch 62.

A power connection (not shown) can be provided to allow the headphones 20 to be recharged. A cover 66 can be provided to protect the contacts of the power connection when not in use.

Figure 16:
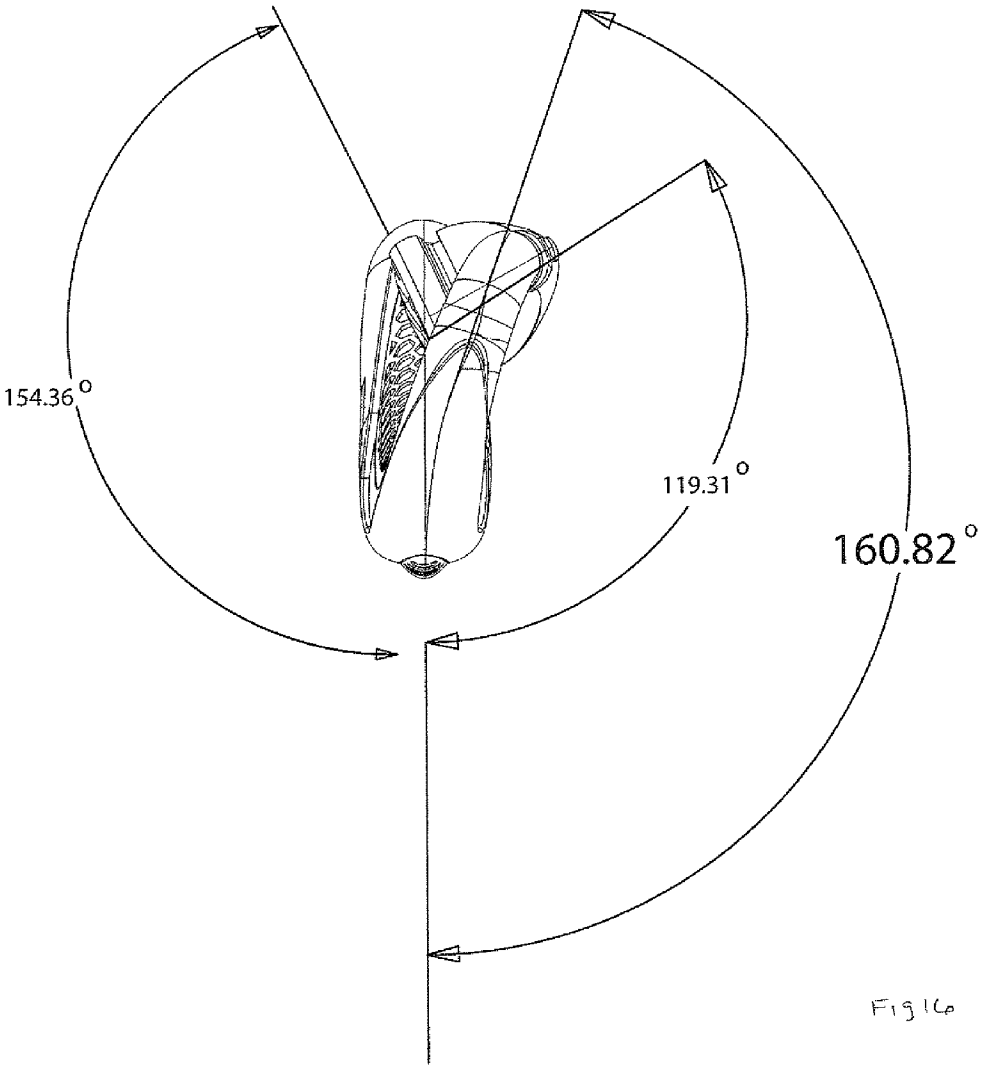
FIG. 16 is a top plan view of the right ear earphone with the enhancer removed, illustrating some of the angular orientations of the preferred embodiment.

As shown in FIG. 16, the C-shaped body 28 twists along its longitudinal axis. The twist is preferably between about 10 and 30 degrees, more preferably between about 15 and 25 degrees, and in this preferred embodiment about 20 degrees. The face of the speaker 28 is preferably oriented about 26 degrees out of the plane of earphone 22, 24, this allows the sound tunnel to be slightly misaligned with the ear canal so that the resilient support 44 must be twisted slightly to properly position the sound tunnel, this twisting applies a resilient bias of the C-shaped support 28 against the side of the user's head.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A wireless headphone comprising left and right earphones connected by a cable, each of the left and right earphones comprising a generally C-shaped body adapted to fit behind a user's ear, the body having a concave inner edge, a convex outer edge, a first end that is positioned generally adjacent a top of the user's ear and a second end positioned generally adjacent a bottom of the user's ear when the body is positioned behind the user's ear;

a resilient support extending forwardly and downwardly from the first end of the C-shaped body; and a speaker supported by the resilient support and having a sound tunnel associated therewith adapted to fit in an ear canal of the user;

wherein the support in a normal configuration supports the speaker in a position in which the sound tunnel is not aligned, with the user's ear canal, wherein the support resiliently deflects to allow the sound tunnel to align with and be inserted into the user's ear canal, thereby resiliently engaging the C-shaped body against the user's head.

2. The wireless headphone according to claim 1, wherein a distance between the concave inner edge of the earphone and the sound tunnel is less than a distance between a back of the user's ear and the user's ear canal, and wherein the support resiliently deflects to allow the sound tunnel to align with and be inserted into the user's ear canal, thereby resiliently biasing the concave inner edge of the C-shaped body against the back of the user's ear.

3. The wireless headphone according to claim 1, wherein an angle of the sound tunnel is misaligned with an angle of the user's ear canal, and wherein the support resiliently deflects by twisting to allow the sound tunnel to align with and be inserted into the user's ear canal, thereby resiliently biasing the C-shaped body against a side of the user's head.

4. The wireless headphone according to claim 1, wherein a distance between the concave inner edge of the earphone and the sound tunnel is less than a distance between the back of the user's ear and the ear canal and wherein an angular orientation of the sound tunnel is misaligned with an angle of the user's ear canal, and wherein the support resiliently deflects to allow the sound tunnel to align with and be inserted into the user's ear canal, thereby resiliently biasing the concave inner edge of the C-shaped body against a back of the user's ear, and the support resiliently deflects by twisting to allow the sound tunnel to align with and be inserted into the user's ear canal, thereby resiliently biasing the C-shaped body against a side of the user's head.

5. The wireless headphone according to claim 1, wherein the support is generally L-shaped, with a first portion extending generally outwardly from the first end of the C-shaped body, and a second portion extending from an end of the first portion, generally parallel to the C-shaped body.

6. The wireless headphone according to claim 1, wherein the C-shaped body comprises a hard resilient exoskeleton forming the concave outer edge.

7. The wireless headphone according to claim 1, wherein the C-shaped body comprises a compliant material with a textured surface on the concave inner edge.

8. The wireless headphone according to claim 7, wherein the textured surface comprise a raised network of hollow polygons.

9. The wireless headphone according to claim 1, wherein the C-shaped body twists along its longitudinal axis to form a curve in the plane of the C-shaped body, to accommodate a curve of the user's head.

10. The wireless headphones according to claim 1, further comprising a light source on the inner concave surface of at least one of the earphones, oriented to face the user's ear when the earphone is mounted on the user's ear.

11. The wireless headphones according to claim 10, wherein the light source emits non-white colored light.

12. The wireless headphones according to claim 10, wherein the light source includes an LED.

13. The wireless headphone according to claim 1, wherein the C-shaped body has a generally triangular cross-section, being wider at the convex outer edge than at the concave inner edge.

14. A wireless headphone comprising left and right earphones connected by a cable, each of the left and right earphones comprising a generally C-shaped body adapted to fit behind a user's ear, the body having a concave inner edge, a convex outer edge, a first end that is positioned generally adjacent a top of the user's ear and a second end positioned generally adjacent a bottom of the user's ear when the body is positioned behind the user's ear;

a resilient support extending forwardly and downwardly from the first end of the C-shaped body;

a speaker coupled to the resilient support and having a sound tunnel associated therewith adapted to fit in an ear canal of the user; and a light source on the inner concave surface of at least one of the earphones, oriented to face the user's ear when the earphone is mounted on the user's ear.

15. The wireless headphone according to claim 14, wherein the C-shaped body has a generally triangular cross-section, being wider at the convex outer edge than at the concave inner edge.

16. The wireless headphone according to claim 14, wherein the support is generally L-shaped, with a first portion extending generally outwardly from the first end of the C-shaped body, and a second portion extending from an end of the first portion, generally parallel to the C-shaped body.

17. A wireless headphone comprising left and right earphones connected by a cable, each of the left and right earphones comprising a generally C-shaped body adapted to fit behind a user's ear, the body having a concave inner edge, a convex outer edge, a first end that is positioned generally adjacent a top of the user's ear and a second end positioned generally adjacent a bottom of the user's ear when the body is positioned behind the user's ear, wherein the C-shaped body has a generally triangular cross-section, being wider at the convex outer edge than at the concave inner edge;

a resilient support extending forwardly and downwardly from the first end of the C-shaped body; and a speaker coupled to the resilient support and having a sound tunnel associated therewith adapted to fit in an ear canal of the user.

18. The wireless headphone according to claim 17, wherein the C-shaped body comprises a compliant material with a textured surface on the concave inner edge.

19. The wireless headphone according to claim 18, wherein the textured surface comprise a raised network of hollow polygons.

20. The wireless headphone according to claim 17, wherein the support is generally L-shaped, with a first portion extending generally outwardly from the first end of the C-shaped body, and a second portion extending from an end of the first portion, generally parallel to the C-shaped body.

* * * * *